United States Patent [19]

Harvey et al.

[11] 4,349,036

[45] Sep. 14, 1982

[54] DISPOSABLE ASHTRAY

[76] Inventors: Francis K. Harvey, 413 Trippe Ave., Easton, Md. 21601; Larrabee Franks, 515 Druid Hill Ave., Salisbury, Md. 21801; David L. Ingraham, E. Walnut St., Delmar, Del. 19940

[21] Appl. No.: 199,372

[22] Filed: Oct. 21, 1980

[51] Int. Cl.[3] ..... A24F 19/02

[52] U.S. Cl. ..... 131/240 R; 131/231

[58] Field of Search ..... 131/235 R, 231, 238, 131/240 R, 241; 220/1 H, 405, 85 H; 206/242, 246, 496; 229/1.5 H; 248/146, 152, 153; 119/61

[56] References Cited

U.S. PATENT DOCUMENTS

| | | | |
|---|---|---|---|
| D. 119,310 | 3/1940 | Pesce | 131/231 |
| 339,694 | 4/1886 | Rive | 119/61 |
| 2,071,394 | 2/1937 | Douglas | 229/1.5 R |
| 2,328,563 | 5/1943 | Lighter | 131/231 |
| 3,270,912 | 9/1966 | Winkelreid | 220/405 |
| 4,027,683 | 6/1977 | Lawbaugh | 131/235 R |

*Primary Examiner*—Stephen C. Pellegrino

*Attorney, Agent, or Firm*—Lowe, King, Price & Becker

[57] ABSTRACT

A disposable ashtray comprises an X-shaped, permanent base (16) supporting a replaceable liner (10) formed of a nonflammable material. The liner (10) has a central trough shaped portion (24) for storing ash and outwardly extending side flanges (32, 34) formed with recesses (36) for supporting cigarettes. The surface of the liner is inwardly embossed (42) to help retain it to the base by negative pressure. The liner is foldable for compact storage.

7 Claims, 9 Drawing Figures

FIG. 1a
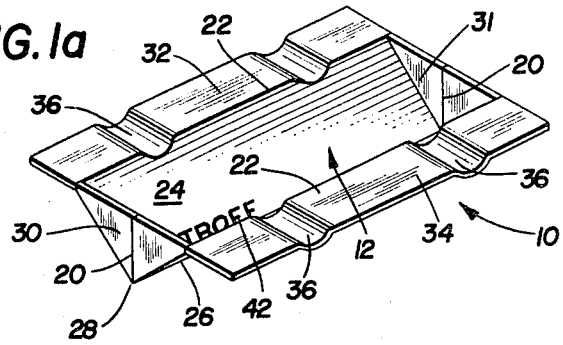
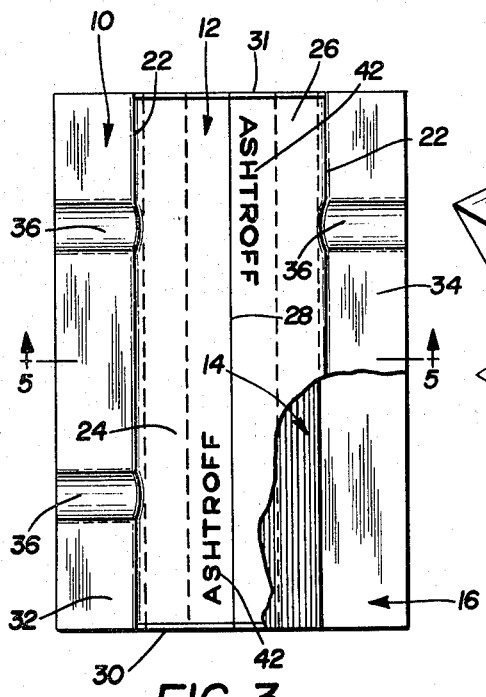
FIG. 3
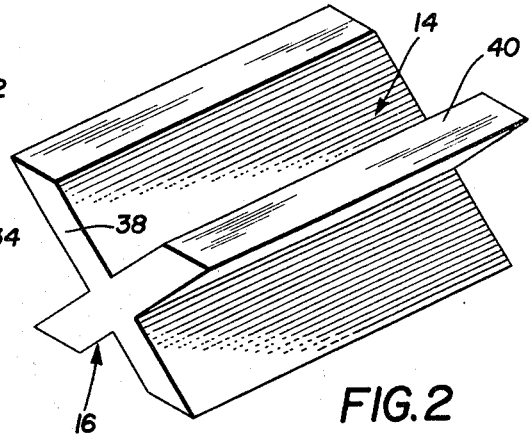
FIG. 2
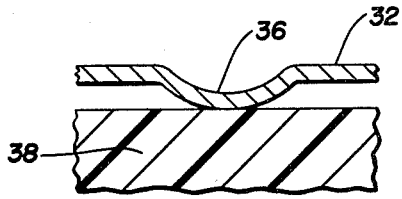
FIG. 6
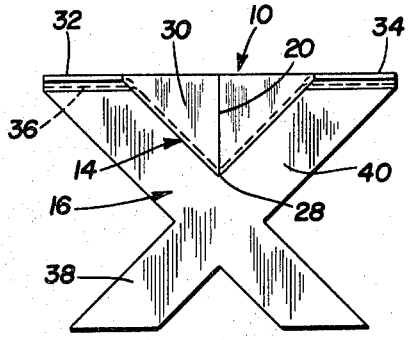
FIG. 4
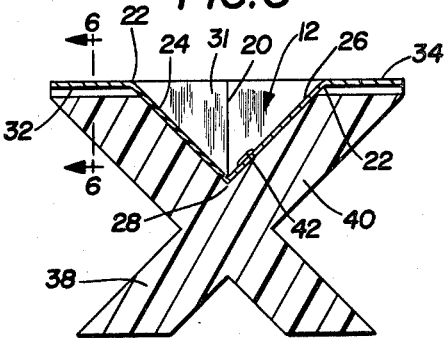
FIG. 5

DISPOSABLE ASHTRAY

TECHNICAL FIELD

The present invention relates generally to ashtrays and more particularly to ashtrays of a type comprising a disposable liner on a permanent base.

BACKGROUND ART

In order to eliminate the inconvenience of cleaning ashtrays, e.g., in a restaurant or office wherein there is heavy ashtray usage, ashtrays are often of a completely disposable type, as in Seez U.S. Pat. No. 2,073,498, or are sometimes in the form of disposable liners supported on a permanent base as in Lawbaugh 4,027,683. The liners for this latter type of ashtray, which are circular, present a storage problem since they cannot be folded into a flat package. Further, because the liner is circular, the cigarette supporting recesses in the liner orient the cigarettes radially; this is somewhat inconvenient since cigarettes tend to interfere with one another at the center of the liner.

Accordingly, one object of the present invention is to provide a new and improved disposable ashtray having a liner that is foldable for compact storage.

Another object is to provide an ashtray having a disposable liner which is capable of supporting a number of cigarettes without mutual interference.

Another object is to provide a disposable ashtray that is convenient to use and is attractive in appearance.

DISCLOSURE OF INVENTION

A disposable ashtray, in accordance with the invention, comprises an elongated, replaceable liner formed of a nonflammable material supported on a stationary base member. The liner has a trough shaped central region for storing ash and outwardly extending flanges adjacent the trough shaped region formed with recesses for supporting cigarettes. The base member is X-shaped in end-view with an upper portion defining a trough corresponding to the trough shaped region of the liner. Inwardly extending embossments formed in the surface of the trough shaped portion of the liner help retain the liner against the base by negative pressure.

Still other objects and advantages of the present invention will become readily apparent to those skilled in this art from the following detailed description, wherein we have shown and described only the preferred embodiments of the invention, simply by way of illustration of the best modes contemplated by us of carrying out our invention. As will be realized, the invention is capable of other and different embodiments, and its several details are capable of modifications in various obvious respects, all without departing from the invention. Accordingly, the drawings and description are to be regarded as illustration in nature and not as restrictive.

BRIEF DESCRIPTION OF DRAWING

FIG. 1*a* is a perspective view of a preferred embodiment of a disposable ashtray liner in accordance with the invention;

FIG. 2 is a perspective view of an ashtray base, in accordance with the invention, for supporting the liner shown in FIGS. 1*a*–1*d;*

FIG. 3 is a top view of the ashtray liner seated on the supporting base;

FIG. 4 is an end view of the replaceable liner and supporting base of FIG. 3;

FIG. 5 is a cross sectional view of the liner and supporting base taken along the line 5—5 in FIG. 3 to expose the embossments formed in the liner surfaces; amnd FIG. 6 is a detailed view showing a cigarette supporting recess seated on the permanent base.

BEST MODE FOR CARRYING OUT THE INVENTION

Figure 1B:
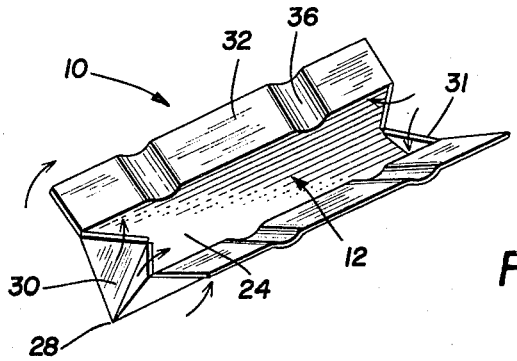
FIG. 1*b* is a perspective view illustrating how the liner in FIG. 1 may be folded for storage.

Referring to FIG. 1, a disposable ashtray liner 10, in accordance with the invention, made of metal foil or any other suitable nonflammable material, is formed with a central, trough shaped region 12 adapted to be supported within a corresponding trough shaped portion 14 of a permanent base 16 (FIG. 2). The liner 10 may be stamped from sheet stock or may be folded from a precut pattern into the configuration shown in FIG. 1*a.* The trough shaped central region 12 of liner 10 is formed by inwardly extending walls 24 and 26 joined to each other along apex 28. End walls 30 and 31 extending between inclined walls 24 and 26 are formed with center score lines 20 to enable the end walls to fold inwardly for storage as shown in FIG. 1*b.*

A pair of outwadly extending flanges 32 and 34 at opposite sides of trough 24 are formed along score lines 22 to permit the flanges to pivot upwardly, as shown in FIG. 1*b,* to enable the liner 10 to be folded into a flat package for storage or disposal.

Figure 1C:
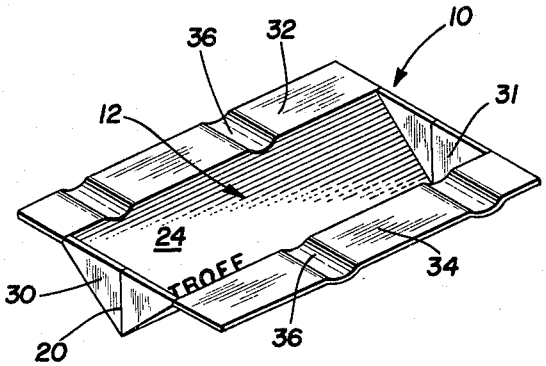
FIG. 1*c* is a perspective view of a first modification of the liner shown in FIG. 1*a;*
Figure 1D:
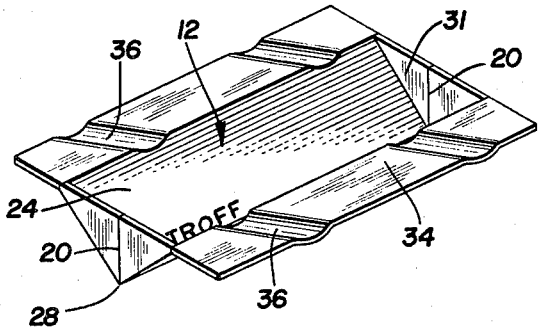
FIG. 1*d* is a perspective view of a second modification of the liner.

A series of cigarette supporting recesses 36 is formed in the flanges 32, 34. The flanges 32 and 34 are slightly spaced above the upper surfaces of supporting legs 38 and 40 by the recesses 36, as shown in FIG. 6. As shown in FIG. 1*a,* recesses 36 are preferably parallel to each other and, as shown in FIGS. 1*a* and 1*c,* may be normal to the central axis of trough 24 to minimize interference among supported cigarettes. In the embodiment of FIG. 1*a,* opposite recesses 36 are positioned on a common axis, whereas in the embodiment of FIG. 1*c,* opposite recesses are staggered. In accordance with another embodiment shown in FIG. 1*d,* the recesses 36 may be oriented at an angle relative to the common axes. The orientations of the cigarette supporting recesses as shown in FIGS. 1*b,* 1*c* and 1*d* are particularly advantageous because any interference among cigarette ends at the center of the trough 24 is eliminated.

Referring to FIGS. 3 and 4, the liner 10 is positioned on the permanent supporting base 16 such that the trough 12 is seated within the trough shaped upper portion 14 of the base. The base 16 is X-shaped as shown in FIG. 2 with outwardly extending arms 38 and 40 defining the supporting trough 14. The X-shaped configuration of base 16 is particularly advantageous since it maintains the liner 10 spaced apart from the table or other supporting surface while maintaining the centroid of the liner and base over the horizontal center of the base for maximum stability.

Referring to FIGS. 3 and 5, a series of inwardly extending embossments 42 is formed in the surfaces of liner walls 24 and 26. These embossments, as shown in cross section in FIG. 5, help return the liner 10 seated against the surface of the base 16 by slight negative pressure or suction within the volume defined by the embossments. Negative pressure within the embossments is established by pressing the embossments against the surface of the base 16 when the insert 10 is first positioned on the base. The magnitude of the negative pressure within the embossments is, of course, very small. We have found, however, that the embossments do help retain the liner 10 in position on base 16 and reduce any tendency of the liner 10 to shift longitudinally within the supporting trough 14.

Thus, there has been provided a disposable ashtray having a replaceable liner 10 that may be folded into a flat package for compact storage prior to use and for disposal following use. The configuration of the liner 10 minimizes interference among cigarette ends and positions cigarettes for direct access to users on opposite sides of a table. The liner is conveniently positioned on the upper surface of an attractive permanent base and is stabilized in place on the base by surface embossments 42.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

We claim:

1. A disposable ash tray, comprising:

an elongated liner formed of a nonflammable material, said liner having a trough shaped portion for storing ash;

a base member having a trough shaped supporting surface for receiving the trough shaped portion of said liner, said liner having a pair of substantially horizontal flanges extending outwardly from opposite sides of said trough shaped portion, respectively, at least part of each of said flanges being supported on said base member, at least one cigarette receiving recessed portion formed on at least one of said flanges adjacent the trough shaped portion.

2. The ashtray of claim 1, wherein said base member is X-shaped, outwardly extending legs of an upper portion of said X-shaped member forming the liner receiving trough.

3. The ashtray of claim 1, wherein said liner and base are rectangular in top view.

4. The ashtray of claim 1, wherein a plurality of recesses are formed in said flanges, said recesses being parallel to each other and normal to opposite sides of said liner.

5. The ashtray of claim 1, wherein a plurality of recesses are formed in said flanges, said recesses being parallel to each other and forming an oblique angle with opposite sides of said liner.

6. The ashtray of claim 4, wherein corresponding recesses on opposite ones of said flanges are staggered.

7. The ashtray of claim 1, wherein said liner includes a pair of opposite end walls, said end walls each being bisected by a central score line, said flanges intersecting said trough shaped portion at longitudinal score lines, said end walls and said flanges being foldable about said central and longitudinal score lines.

* * * * *